US007269870B2

(12) United States Patent
Kim

(10) Patent No.: US 7,269,870 B2
(45) Date of Patent: Sep. 18, 2007

(54) WASHING MACHINE CONTROL METHOD

(75) Inventor: Jong Ho Kim, Changwon-si (KR)

(73) Assignee: LG Electronics Inc., Seoul (KR)

( * ) Notice: Subject to any disclaimer, the term of this patent is extended or adjusted under 35 U.S.C. 154(b) by 548 days.

(21) Appl. No.: 10/717,907

(22) Filed: Nov. 21, 2003

(65) Prior Publication Data

US 2004/0148710 A1 Aug. 5, 2004

(30) Foreign Application Priority Data

Nov. 26, 2002 (KR) ..... 10-2002-0073899

(51) Int. Cl.
*D06F 35/00* (2006.01)
*D06F 39/00* (2006.01)

(52) U.S. Cl. ..... 8/158; 8/159

(58) Field of Classification Search ..... 8/158, 8/159

See application file for complete search history.

(56) References Cited

U.S. PATENT DOCUMENTS 6,247,339 B1 * 6/2001 Kenjo et al. ..... 68/12.04
2003/0027579 A1 * 2/2003 Sydon ..... 455/452
2003/0056300 A1 * 3/2003 Ruhl et al. ..... 8/158

FOREIGN PATENT DOCUMENTS

| | | |
|---|---|---|
| KR | 1989-8386 | 7/1989 |
| KR | 1999-13035 | 2/1999 |

* cited by examiner

*Primary Examiner*—Michael Kornakov
*Assistant Examiner*—Rita R Patel
(74) *Attorney, Agent, or Firm*—McKenna Long & Aldridge LLP

(57) ABSTRACT

A washing machine control method a thorough soaking of laundry before performing a washing step in a washing machine having a variable speed tub and a variable speed pulsator. The method includes steps of setting a water level in the tub; supplying water to the tub according to the water level setting step; rotating the pulsator at a first predetermined speed during the water supplying step; and rotating the pulsator and tub at a second predetermined speed during the water supplying step until the water in the tub reaches the set water level.

7 Claims, 10 Drawing Sheets

WASHING MACHINE CONTROL METHOD

This application claims the benefit of Korean Application No. 10-2002-0073899 filed on Nov. 26, 2002, which is hereby incorporated by reference.

BACKGROUND OF THE INVENTION

1. Field of the Invention

The present invention relates to a washing machine control method, and more particularly, to a method for achieving a thorough soaking of laundry in a washing machine before performing a washing step.

2. Discussion of the Related Art

In the operation of a typical washing machine, laundry is placed inside and then water is supplied for performing a washing step according to a wash course selected by a user. The wash course includes such parameters as a water level based on an amount of laundry placed in the washing machine.

Referring to FIG. 1, a typical washing machine is comprised of a body 4 constituting the overall shape of the washing machine, an outer tub 1 for holding water installed in the body 4, an inner tub 2 installed rotatably in the outer tub, and a pulsator 6 provided on a center of a bottom of the inner tub for right-to-left agitation on washing and dewatering. A clutch/motor assembly 5, installed under the outer tub 1, is provided with a shaft for coupling to the inner tub 2 and pulsator 6, to enable a variable speed control of the inner tub and pulsator according to a speed control signal from a control circuit (not shown). The pulsator 6 is fixed to the washing shaft of the clutch/motor 5 to rotate right-to-left, to generate a mixing action for performing washing, and is equivalent to any washing force generating apparatus for use in a general washing machine. A water supply valve 8 for controlling the supply of water for washing and rinsing is installed at one upper side of the body 4 to supply water in the outer tub, and a drain valve 7 is installed under one lower side of the outer tub 1 in the body 4 to control a discharge of the water from the outer tub 1 after completion of a washing step. Valves 8 and 7 are controlled by a control signal of a control unit (not shown). The water supply valve 8 is generally provided on an upper rear side of the washing machine and is connected to a domestic service pipe through a water supply hose (not shown).

Referring to FIG. 2, illustrating a washing machine control method according to a related art, a dry laundry amount is sensed (S1), and a water level is set and supplied according to the sensed dry laundry amount (S2, S3, S4). Thereafter, a washing step is performed to completion according to a selected wash course (S5, S6).

In the washing machine control method as described above, the water supply is achieved according to a water level set by sensing the dry laundry amount, i.e., before supplying any water. Therefore, as the water is supplied to the tub having an amount of laundry placed therein, the water tends to settle at a level without being fully absorbed into the laundry, such that the level changes after full absorption. Initiating the washing step without evenly soaking the laundry in water, however, fails to achieve the desired water level, and washing performance is reduced accordingly.

Meanwhile, a detergent may be supplied together with the water. Without a complete mixing of the laundry into the water, however, the detergent may not be dissolved properly into the water, and as a result, may damage the laundry by adhering to the laundry at localized points.

SUMMARY OF THE INVENTION

Accordingly, the present invention is directed to a soaking method of a washing machine that substantially obviates one or more of the problems due to limitations and disadvantages of the related art.

An object of the present invention, which has been devised to solve the foregoing problem, lies in providing a soaking method of a washing machine, which enables laundry to absorb water evenly before a washing step is performed.

Additional features and advantages of the invention will be set forth in the description which follows, and in part will be apparent to those having ordinary skill in the art upon examination of the following or may be learned from a practice of the invention. The objectives and other advantages of the invention will be realized and attained by the subject matter particularly pointed out in the specification and claims hereof as well as in the appended drawings.

To achieve these objects and other advantages in accordance with the present invention, as embodied and broadly described herein, there is provided a method for controlling a washing machine having a variable speed tub and a variable speed pulsator. The method comprises steps of setting a water level in the tub; supplying water to the tub according to the water level setting step; and rotating the pulsator at a first predetermined speed during the water supplying step. Preferably, the method further comprises a step of rotating the pulsator and tub at a second predetermined speed during the water supplying step until the water in the tub reaches the set water level.

The pulsator according to the present invention is equivalent to any washing force generating apparatus for use in a general washing machine.

It is to be understood that both the foregoing explanation and the following detailed description of the present invention are exemplary and illustrative and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Throughout the drawings, like elements are indicated using the same or similar reference designations where possible.

First Embodiment

Figure 1:
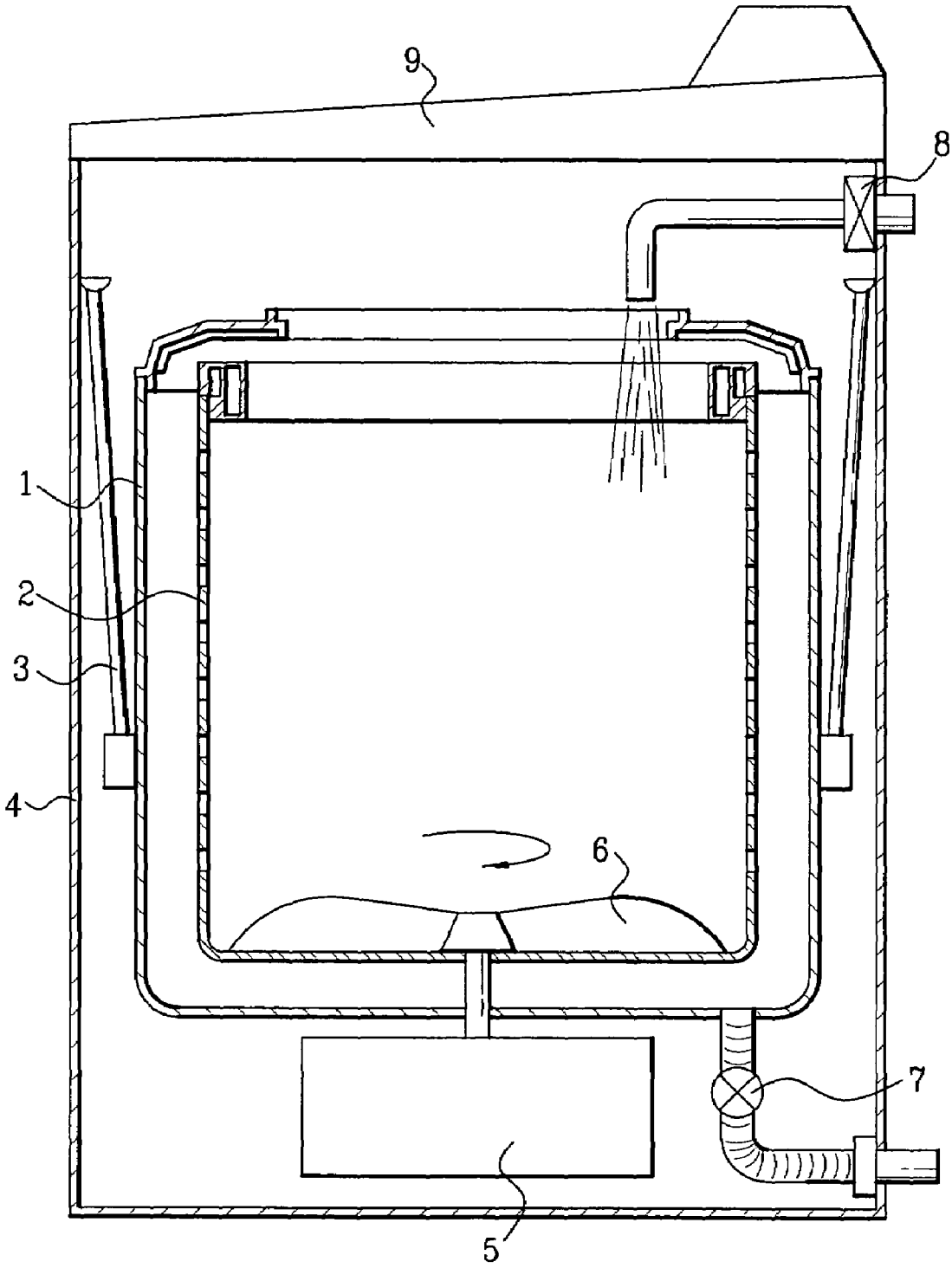
FIG. 1 Related Art
FIG. 1 is a cross-sectional view of a general washing machine.
Figure 2:
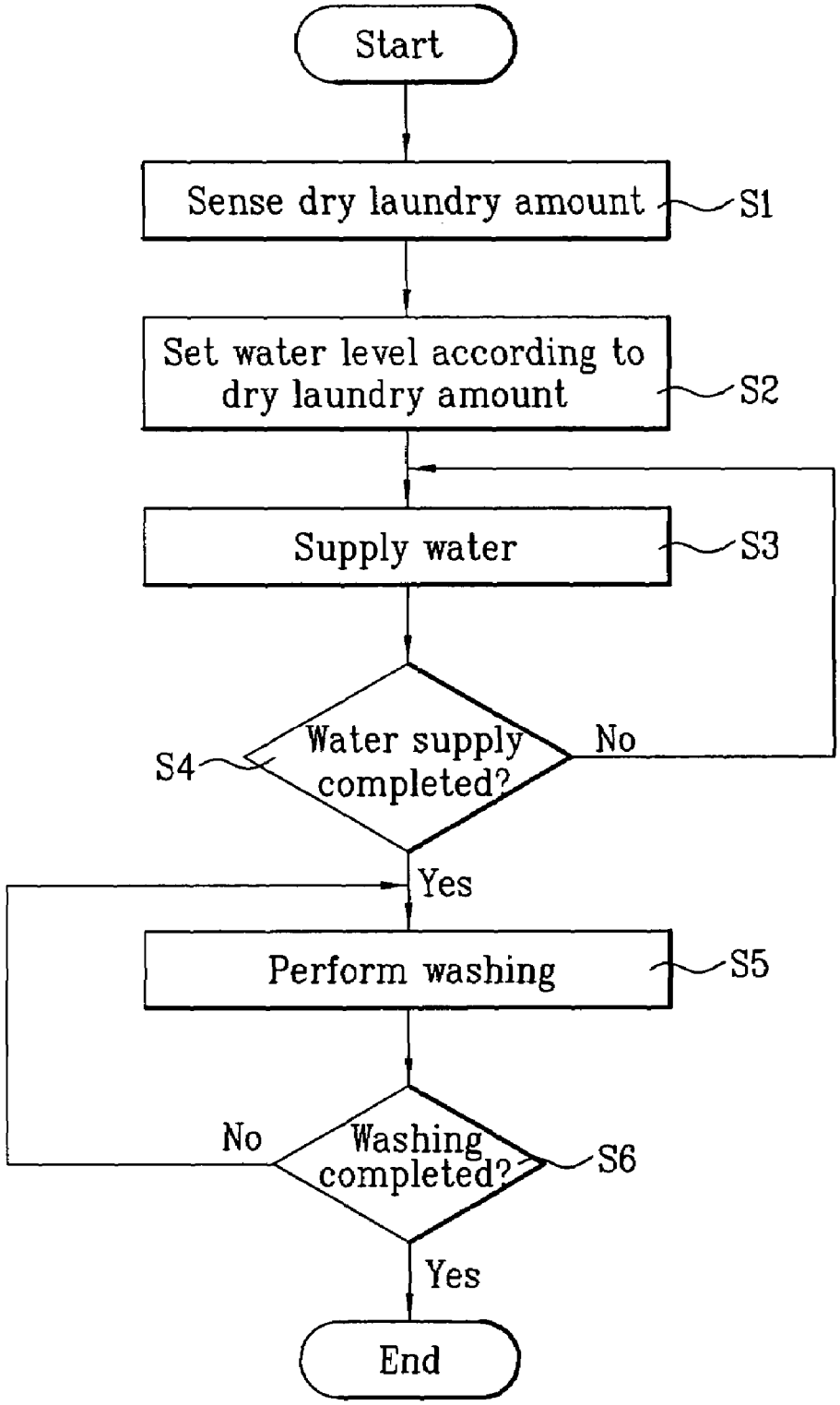
FIG. 2 Related Art
FIG. 2 is a flowchart of a washing machine control method according to a related art.
Figure 3:
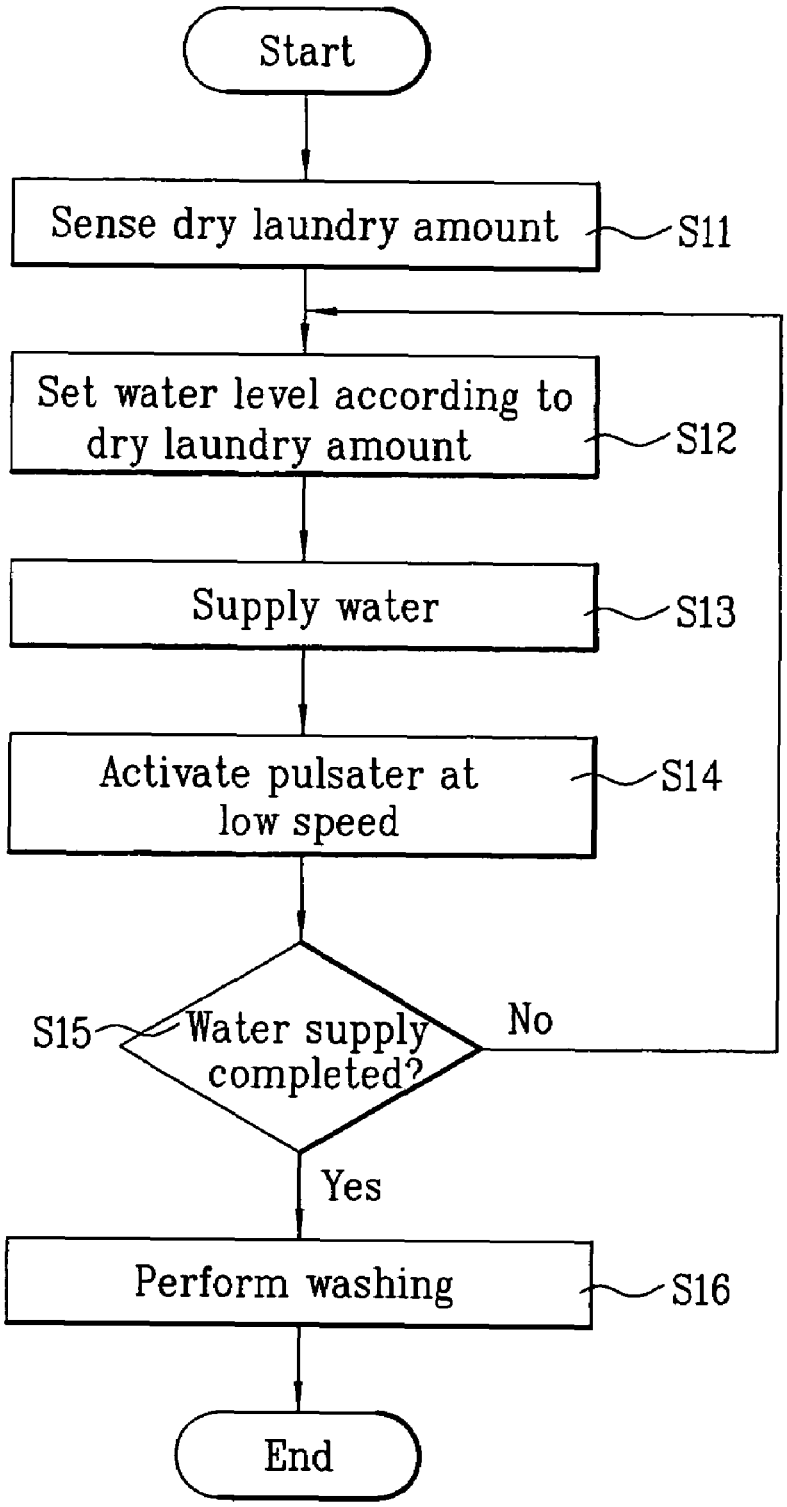
FIG. 3 is a flowchart of a washing machine control method according to a first embodiment of the present invention.
Figure 4:
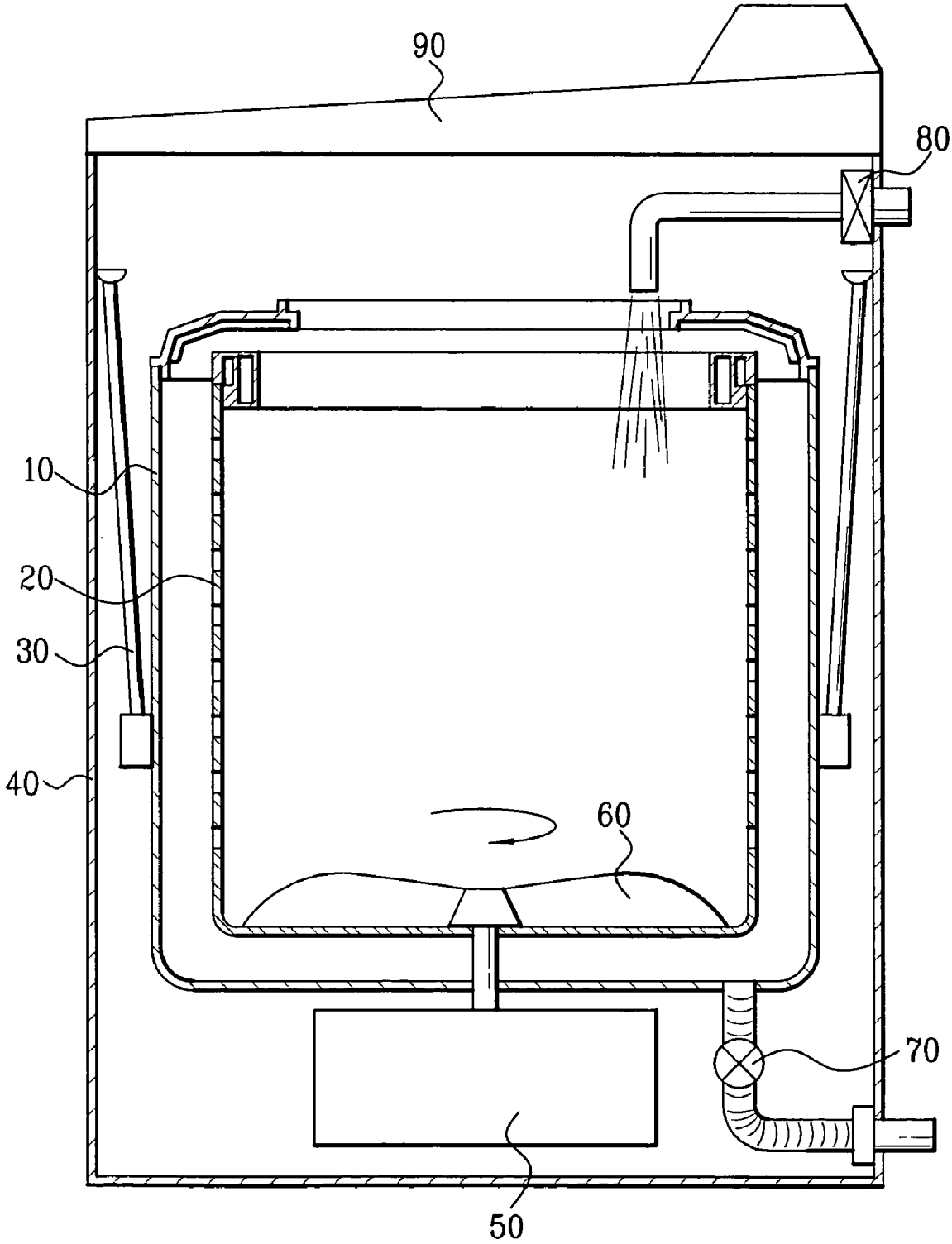
FIG. 4 is a cross-sectional view of a washing machine being driven according to the embodiment of FIG. 3.

Referring to FIG. 4, illustrating a washing machine control method according to a first embodiment of the present invention, a dry laundry amount is sensed (S11), and the water level is set according to the sensed dry laundry amount (S12). Water is supplied (S13), and a pulsator 60 is rotated at a predetermined speed (S14), which is a relatively low speed. Notably, the steps S13 and S14 are performed concurrently until the supply of water is completed (S15) according to the level set in the step S12. Thereafter, washing is performed according to a selected wash course (S16).

Thus, in the first embodiment of the present invention, the pulsator 60 is rotated while the water supply is performed, to churn the laundry placed atop the pulsator so that the laundry absorbs the supplied water evenly. Referring to FIG. 4, illustrating a washing machine being driven according to the first embodiment of the present invention, the pulsator 60 slowly rotates while water is supplied to a tub 1 through a water supply valve 80.

Second Embodiment

Figure 5:
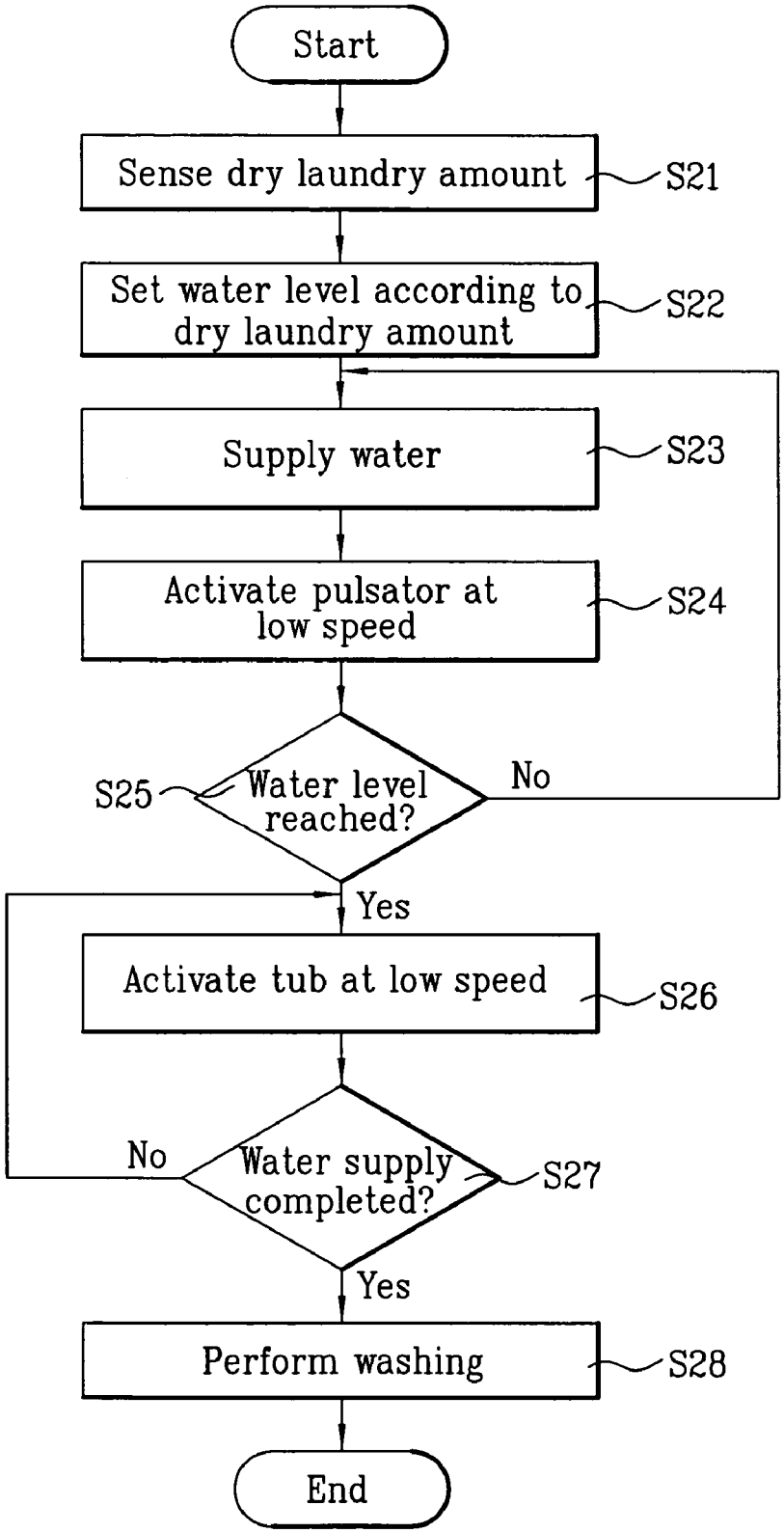
FIG. 5 is a flowchart of a washing machine control method according to a second embodiment of the present invention.

Referring to FIG. 5, illustrating a washing machine control method according to a second embodiment of the present invention, a dry laundry amount is sensed (S21), and the water level is set according to the sensed dry laundry amount (S22). Water is supplied (S23), and a pulsator 60 is rotated at a first predetermined speed (S24), which is a relatively low speed consistent with the pulsator's rotational speed in the first embodiment. Notably, the steps S23 and S24 are performed concurrently until the water level set in the step S12 is reached (S25), but the water supply continues while a step S26 is performed to rotate the tub at a second predetermined speed until the water supply step is completed (S27). Thereafter, washing is performed according to a selected wash course (S28).

Thus, in the second embodiment of the present invention, the pulsator is rotated at a first predetermined speed until a predetermined water level is reached, after which the pulsator and tub are both rotated at a second predetermined speed, while the water supply continues to allow the laundry to absorb the water evenly. The second predetermined speed is slower than the first predetermined speed, so that no substantial centrifugal force is generated, i.e., there is no substantial movement of the laundry.

Figure 6:
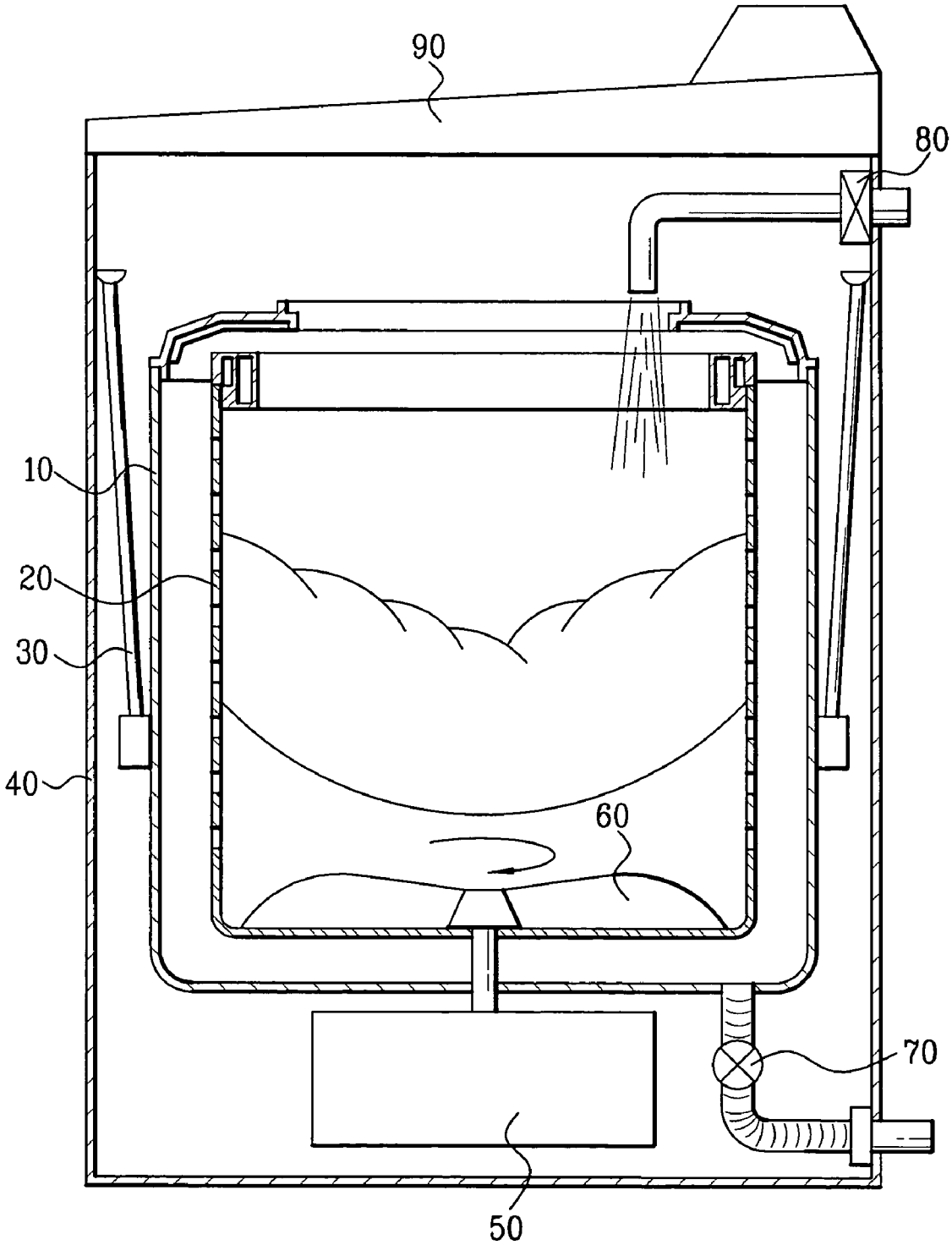
FIG. 6 is a cross-sectional view of a washing machine being driven according to the embodiment of FIG. 5.

Referring to FIG. 6, illustrating a washing machine being driven according to the second embodiment of the present invention, to soak the laundry more evenly than in the first embodiment, the pulsator 60 and inner tub 20 are rotated simultaneously at a second predetermined speed after the pulsator is initially rotated at a first predetermined speed until a predetermined water level is reached. The second predetermined speed is too slow to push the laundry toward an inner circumferential surface of the inner tub 20.

Third Embodiment

Figure 7:
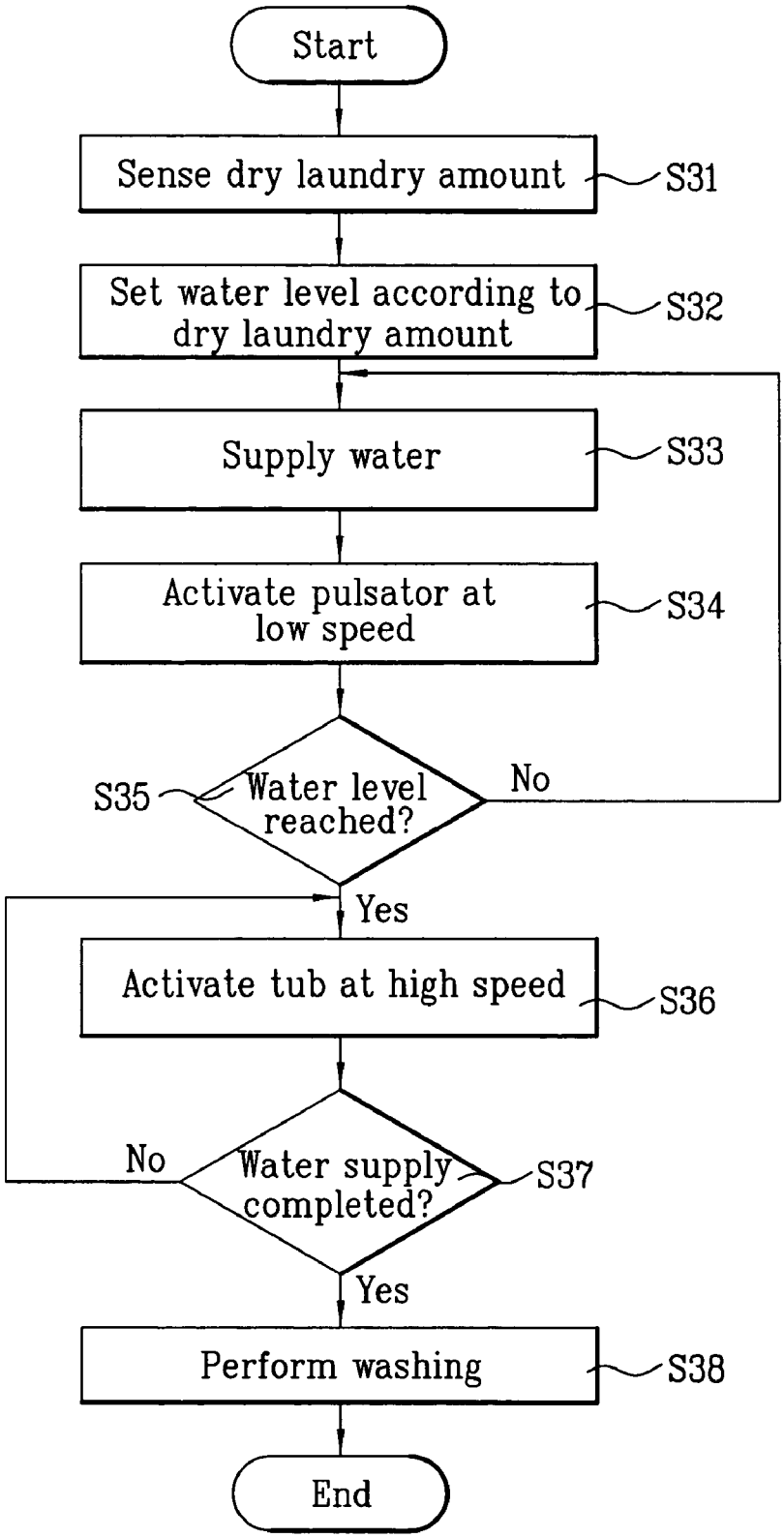
FIG. 7 is a flowchart of a washing machine control method according to a third embodiment of the present invention.
Figure 8:
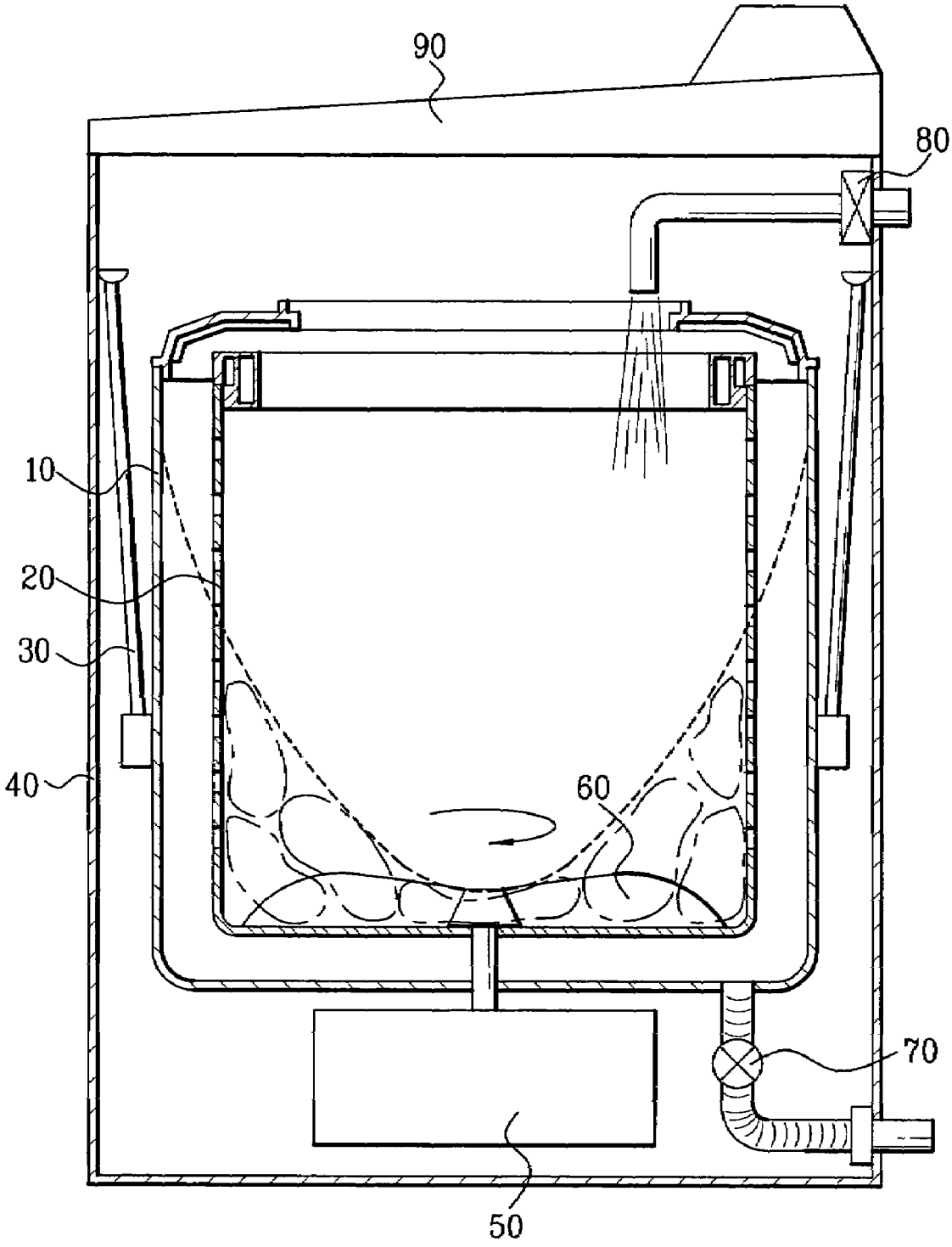
FIG. 8 is a cross-sectional view of a washing machine being driven according to the embodiment of FIG. 7.

Referring to FIG. 7, illustrating a washing machine control method according to a third embodiment of the present invention, a dry laundry amount is sensed (S31), and the water level is set according to the sensed dry laundry amount (S32). Water is supplied (S33), and a pulsator 60 is rotated at a first predetermined speed (S34), which is a relatively low speed consistent with the pulsator's rotational speed in the first embodiment. Notably, the steps S33 and S34 are performed concurrently until the water level set in the step S32 is reached (S35), but the water supply continues while a step S36 is performed to rotate the tub at a third predetermined speed until the water supply step is completed (S37). The third predetermined speed is higher than the second predetermined speed and is sufficient to generate a light centrifugal force on the laundry, as shown in FIG. 8. Thereafter, washing is performed according to a selected wash course (S38).

Referring to FIG. 8, illustrating a washing machine being driven according to the third embodiment of the present invention, to soak the laundry more thoroughly than in the second embodiment, the pulsator 60 and inner tub 20 are rotated simultaneously at a third predetermined speed after the pulsator is initially rotated at a first predetermined speed until a predetermined water level is reached. The third predetermined speed is higher than the second predetermined speed and is sufficient to push the laundry and water against an inner circumferential side of the inner tub 20.

Fourth Embodiment

Figure 9:
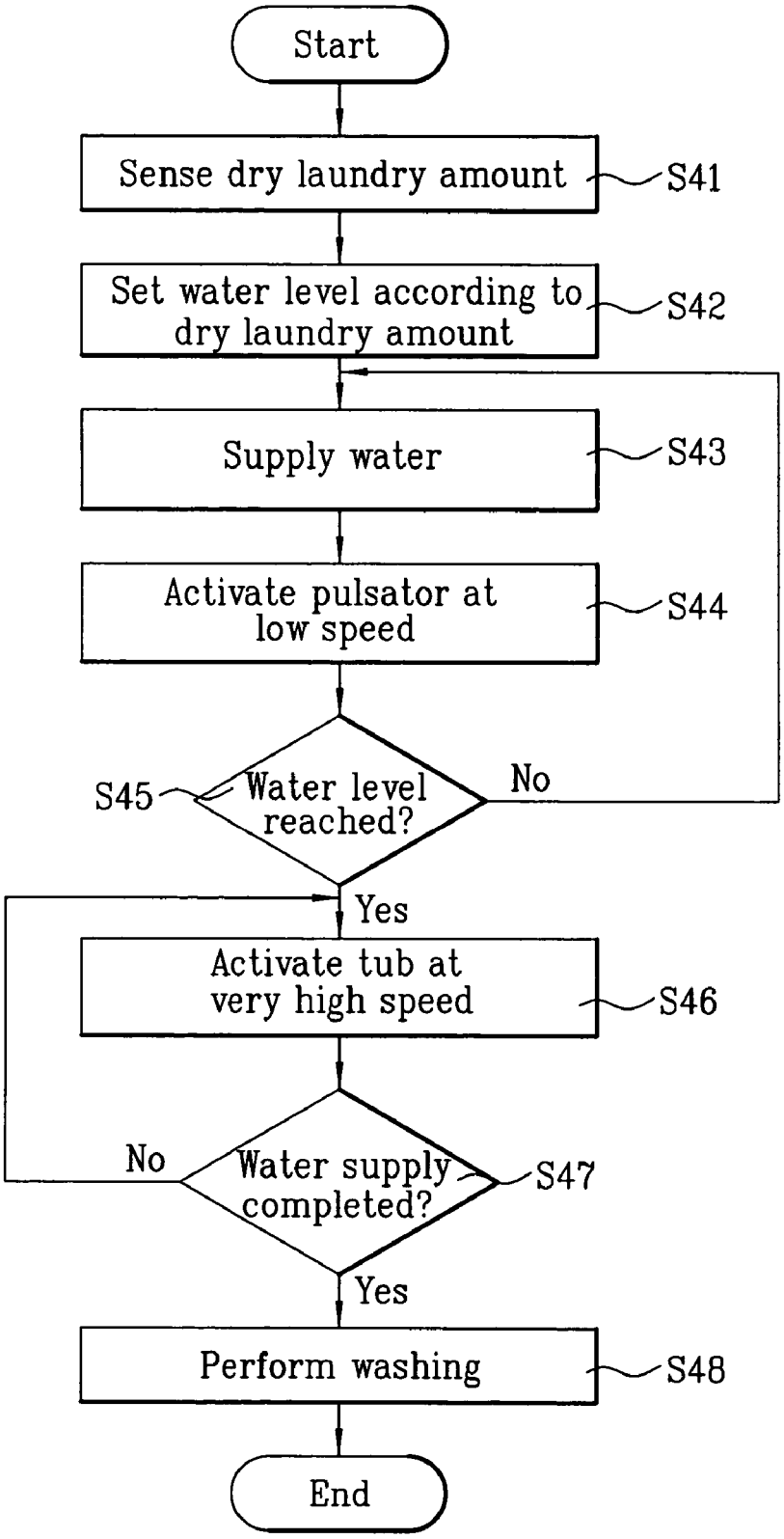
FIG. 9 is a flowchart of a washing machine control method according to a fourth embodiment of the present invention.
Figure 10:
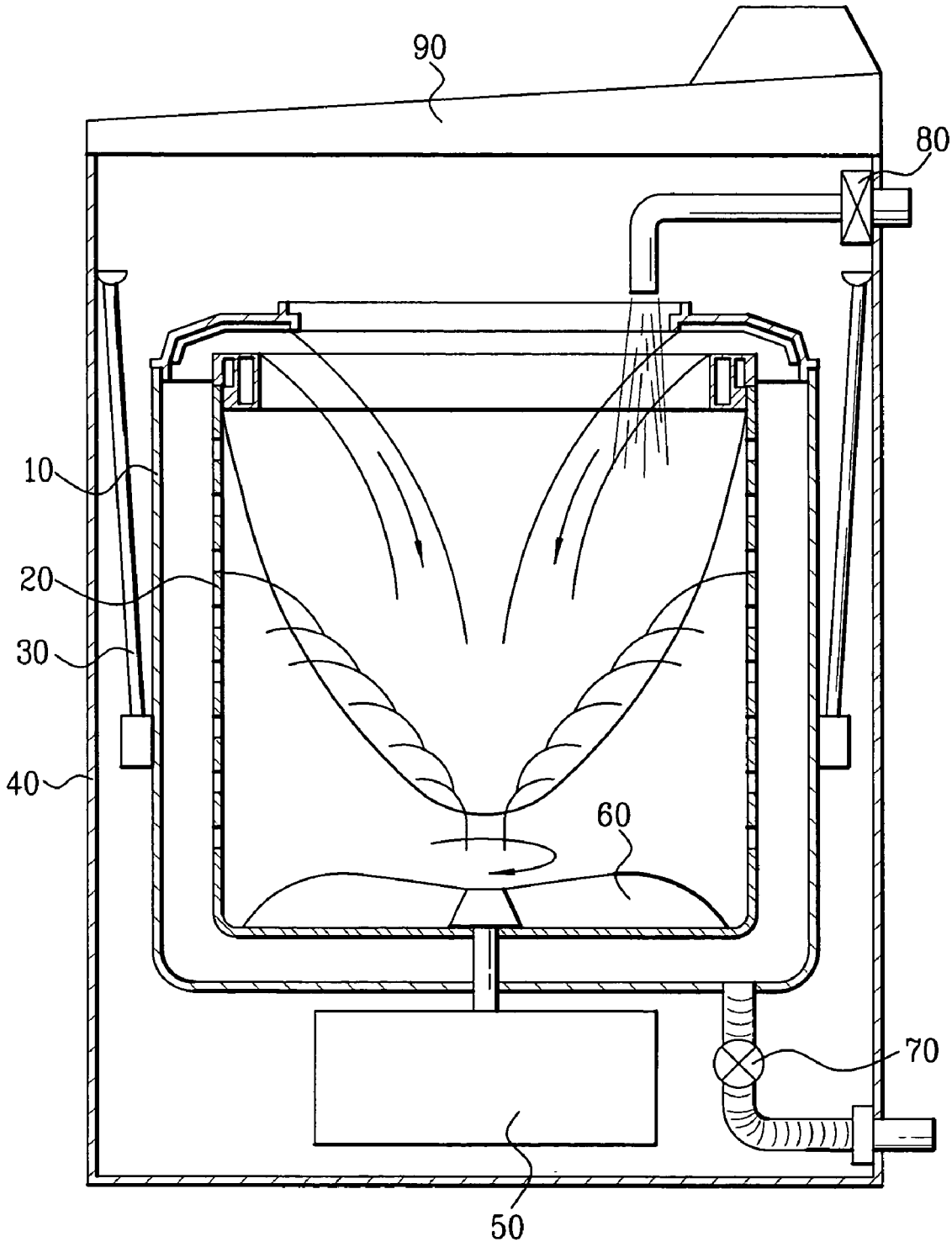
FIG. 10 is a cross-sectional view of a washing machine being driven according to the embodiment of FIG. 9.

Referring to FIG. 9, illustrating a washing machine control method according to a fourth embodiment of the present invention, a dry laundry amount is sensed (S41), and the water level is set according to the sensed dry laundry amount (S42). Water is supplied (S43), and a pulsator 60 is rotated at a first predetermined speed (S44), which is a relatively low speed consistent with the pulsator's rotational speed in the first embodiment. Notably, the steps S43 and S44 are performed concurrently until the water level set in the step S42 is reached (S45), but the water supply continues while a step S46 is performed to rotate the tub at a fourth predetermined speed until the water supply step is completed (S47). The fourth predetermined speed is higher than the third predetermined speed and is sufficient to generate a great centrifugal force on the laundry, as shown in FIG. 10. Thereafter, washing is performed according to a selected wash course (S48).

Referring to FIG. 10, illustrating a washing machine being driven according to the fourth embodiment of the present invention, to soak the laundry thoroughly and more quickly than in the third embodiment, the pulsator 60 and inner tub 20 are rotated simultaneously at a fourth predetermined speed after the pulsator is initially rotated at a first predetermined speed until a predetermined water level is reached. The fourth predetermined speed is higher than the third predetermined speed and is sufficient to push the laundry against an inner circumferential side of the inner tub 20 and to push the water up through an opening at the top of the tub, between the inner and outer tubs, to rain down of the laundry.

As described above, in the washing machine control method according to the present invention, the water level for the washing operation is determined according to a sensed laundry amount. Once the water level is determined, the pulsator and tub are rotated, while the water is supplied, at a speed to make the laundry absorb the water evenly. Hence, the laundry is washed after completely absorbing the water. In addition, by achieving a complete mixing of the laundry into the water, detergent does not become attached to any specific portion of the laundry.

It will be apparent to those skilled in the art that various modifications and variations can be made in the present invention without departing from the spirit or scope of the invention. Thus, it is intended that the present invention cover such modifications and variations, provided they come within the scope of the appended claims and their equivalents.

What is claimed is:

1. A method for controlling a washing machine comprising steps of:

setting a water level in a tub;

supplying water to the tub according to said water level setting step;

rotating a pulsator at a first predetermined speed and a second predetermined speed during said water supplying step, wherein the second predetermined speed is slower than the first predetermined speed;

performing a washing step according to a selected wash course after said water supplying step.

2. A method as claimed in claim 1, wherein the tub is a variable speed tub.

3. A method as claimed in claim 2, wherein the tub rotates with the pulsator at the second predetermined speed during said water supplying step until the water in the tub reaches the set water level.

4. The method as claimed in claim 2, further comprising a step of rotating the pulsator and tub at a third predetermined speed during said water supplying step until the water in the tub reaches the set water level.

5. The method as claimed in claim 4, wherein the third predetermined speed is faster than the first predetermined speed and is sufficient to push the water against an inner circumferential side of the tub.

6. The method as claimed in claim 2, further comprising a step of rotating the pulsator and tub at a fourth predetermined speed during said water supplying step until the water in the tub reaches the set water level.

7. The method as claimed in claim 6, wherein the fourth predetermined speed is sufficient to push the laundry against an inner circumferential side of the tub and to push the water up through a top opening of the tub, to rain down of the laundry.

* * * * *